US010031456B1

(12) United States Patent
Shokai

(10) Patent No.: US 10,031,456 B1
(45) Date of Patent: Jul. 24, 2018

(54) IMAGE FORMING APPARATUS AND CONTROLLING METHOD THEREOF

(71) Applicants: KABUSHIKI KAISHA TOSHIBA, Tokyo (JP); TOSHIBA TEC KABUSHIKI KAISHA, Tokyo (JP)

(72) Inventor: Takeharu Shokai, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/719,215

(22) Filed: Sep. 28, 2017

(30) Foreign Application Priority Data

Mar. 10, 2017 (JP) ..... 2017-045837

(51) Int. Cl.
*G03G 15/00* (2006.01)

(52) U.S. Cl.
CPC ..... *G03G 15/5016* (2013.01); *G03G 15/5041* (2013.01)

(58) Field of Classification Search
CPC ..... G03G 15/5016; G03G 15/5041
USPC ..... 399/80
See application file for complete search history.

(56) References Cited

U.S. PATENT DOCUMENTS

| | | | |
|---|---|---|---|
| 8,537,397 | B2 | 9/2013 | Fukaya |
| 2008/0189693 | A1 | 8/2008 | Pathak |
| 2011/0216362 | A1 | 9/2011 | Fukaya |
| 2011/0219250 | A1 | 9/2011 | Hitaka et al. |
| 2016/0352936 | A1 | 12/2016 | Kanbayashi |

FOREIGN PATENT DOCUMENTS

| | | | |
|---|---|---|---|
| JP | 2004128561 | A | 4/2004 |
| JP | 2007331162 | A * | 12/2007 |
| JP | 2008192130 | A | 8/2008 |

OTHER PUBLICATIONS

Extended European Search Report dated May 4, 2018, mailed in counterpart European Application No. 18157628,1; 8 pages.

* cited by examiner

*Primary Examiner* — Susan Lee
(74) *Attorney, Agent, or Firm* — Patterson & Sheridan, LLP

(57) ABSTRACT

An image forming apparatus according to an embodiment includes an image forming unit, and a processor. The image forming unit forms an image on a printing medium. The processor performs user authentication and, upon performing the user authentication, determines whether or not an image stabilization process should be performed in the image forming unit. The processor then instructs the image forming unit to perform the image stabilization process according to a result of the user authentication.

20 Claims, 4 Drawing Sheets

IMAGE FORMING APPARATUS AND CONTROLLING METHOD THEREOF

CROSS-REFERENCE TO RELATED APPLICATION

This application is based upon and claims the benefit of priority from Japanese Patent Application No. 2017-045837, filed Mar. 10, 2017, the entire contents of which are incorporated herein by reference.

FIELD

Embodiments described herein relate generally to an image forming apparatus and an image forming method.

BACKGROUND

An image forming apparatus executes printing according to a printing request. The image forming apparatus forms an image on a printing medium such as paper and discharges the printing medium on which the image is formed.

For example, the image forming unit forms a latent image (e.g., electrostatic latent image) on a photoconductive drum by charging the photoconductive drum and irradiating the photoconductive drum with light according to image data for printing. The image forming unit attaches a toner to the latent image formed on the photoconductive drum, transfers the toner attached to the latent image onto a printing medium via a transfer belt, and forms a toner image on the printing medium. In addition, the image forming unit fixes the toner image formed on the printing medium by pressing the printing medium on which the toner image is formed by a fixing roller that is heated to a predetermined temperature by a heater, thereby forming the image on the printing medium.

In addition, the image forming apparatus performs an image stabilization process according to a preset condition. For example, the image stabilization process is a process in which a toner concentration of a toner image formed by the image forming unit, a position at which the toner image is formed, and the like are adjusted according to the toner image formed on the transfer belt. The image forming apparatus improves image quality of the image formed on the printing medium by performing the image stabilization process.

However, when the image forming apparatus performs the image stabilization process, various functions in the image forming apparatus cannot be executed. For this reason, there is a problem that a waiting time of a user occurs even when the user does not emphasize image quality of an image.

DETAILED DESCRIPTION

An image forming apparatus according to an embodiment includes an image forming unit, and a processor. The image forming unit forms an image on a printing medium. The processor performs user authentication and, upon performing the user authentication, determines whether or not an image stabilization process should be performed in the image forming unit. The processor then instructs the image forming unit to perform the image stabilization process according to a result of the user authentication.

Hereinafter, an image forming apparatus and an image forming method according to an embodiment will be described with reference to drawings.

Figure 1:
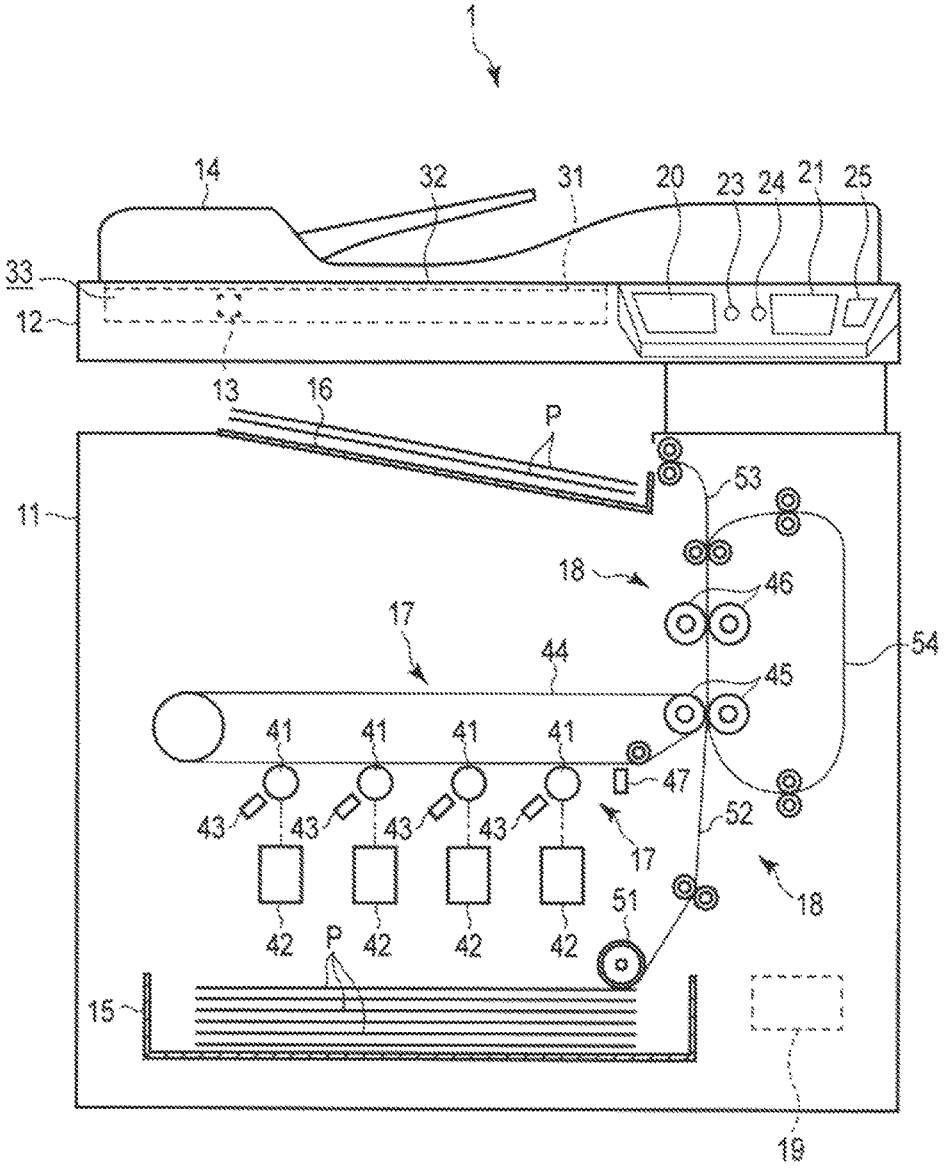
FIG. 1 is a diagram for explaining a configuration example of an image forming apparatus according to an embodiment.
Figure 2:
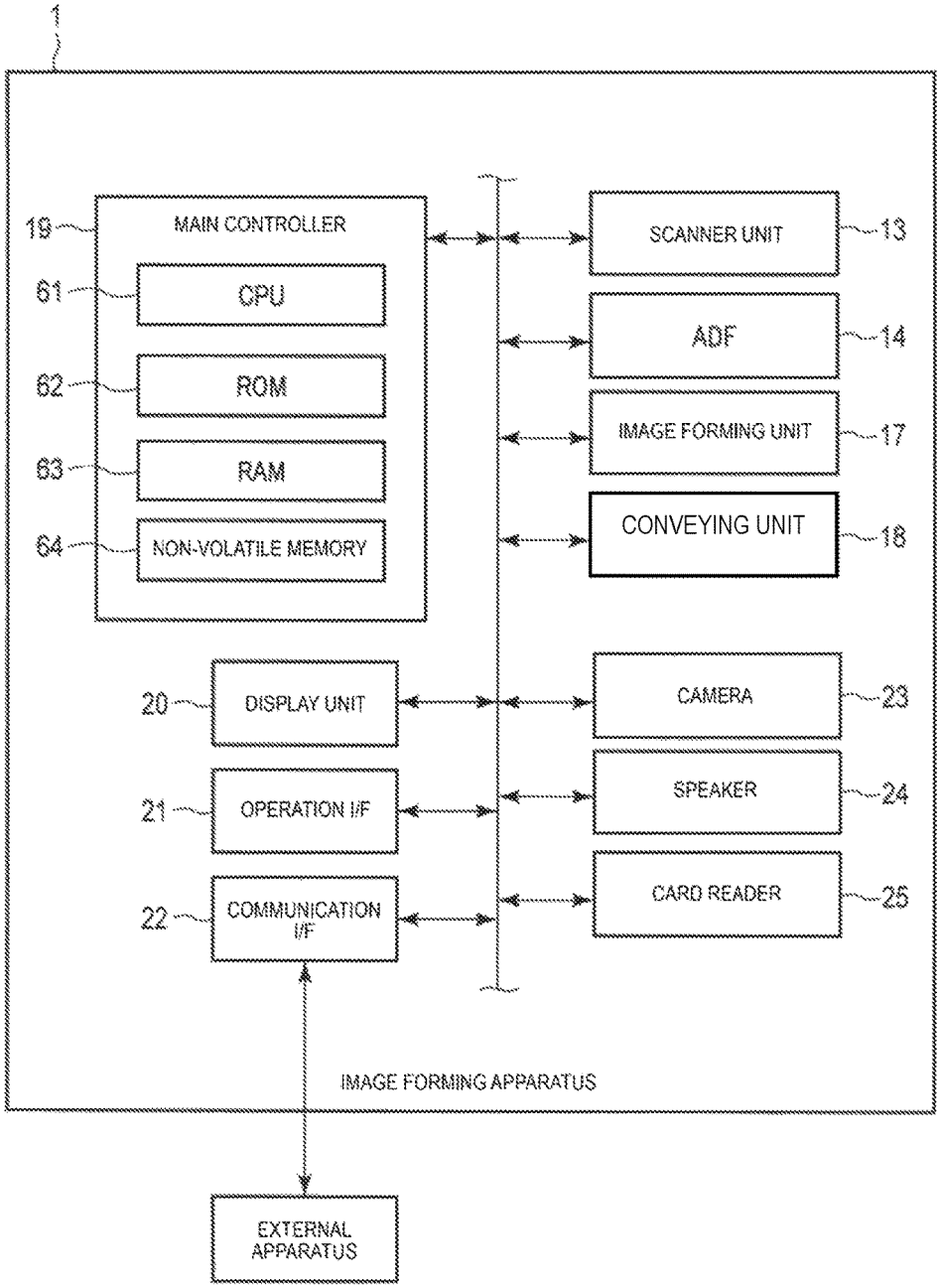
FIG. 2 is a diagram for explaining a configuration example of the image forming apparatus according to the embodiment.

FIG. 1 is an explanatory diagram illustrating a configuration example of an image forming apparatus 1 according to the embodiment. FIG. 2 is a block diagram illustrating a function of the image forming apparatus 1 as a block.

The image forming apparatus 1 is, for example, a multifunction peripheral (MFP) which performs various processes such as image formation while conveying a recording medium such as a printing medium. The image forming apparatus 1 forms a latent image (e.g., electrostatic latent image) on a photoconductive drum by charging the photoconductive drum and irradiating the photoconductive drum with light according to image data for printing. The image forming apparatus 1 attaches a toner to the latent image formed on the photoconductive drum, transfers the toner attached to the latent image onto a printing medium, and forms a toner image on the printing medium. In addition, the image forming apparatus 1 fixes the toner image formed on the printing medium by pressing the printing medium on which the toner image is formed by a fixing roller that is heated to a predetermined temperature by a heater.

Further, the image forming apparatus 1 forms an image of reflected light of light emitted on the printing medium by an image sensor and obtains an image on the printing medium by converting a charge accumulated in the image sensor into a digital signal.

The image forming apparatus 1 includes a housing 11, a document holder 12, a scanner unit 13, an automatic original document feeder (hereinafter, referred to as "ADF") 14, a paper feeding cassette 15, a paper discharge tray 16, an image forming unit 17, a conveying unit 18, a main controller 19, a display unit 20, an operation I/F 21, a communication I/F 22, a camera 23, a speaker 24, and a card reader 25.

The housing 11 is a main body which holds the original document holder 12, the scanner unit 13, the ADF 14, the paper feeding cassette 15, the paper discharge tray 16, the image forming unit 17, the conveying unit 18, the main controller 19, the display unit 20, the operation I/F 21, the communication I/F 22, the camera 23, the speaker 24, and the card reader 25.

The document holder 12 is a portion on which a printing medium P as an original document to be read by the scanner unit 13 is placed. The document holder 12 has a glass plate 31 on the upper surface thereof. The printing medium P as an original document is placed on a placing surface 32 of the glass plate 31. A space 33 is located an opposite side of the placing surface 32 of the glass plate 31.

The ADF 14 includes a mechanism which conveys the printing medium P along a sheet conveying path. The ADF 14 is located on the document holder 12 so as to be opened and closed. According to control of the main controller 19, the ADF 14 feeds the printing medium P placed on a tray and conveys the printing medium P while the printing medium P is in close contact with the glass plate 31 of the document holder 12.

According to control of the main controller 19, the scanner unit 13 obtains an image from the printing medium P. The scanner unit 13 is disposed in the space 33 of the document holder 12. The scanner unit 13 includes an image sensor, an optical element, an illumination, and the like.

The image sensor is an imaging element in which pixels which convert light into an electric signal are arranged in a linear manner. The image sensor is configured with, for example, a Charge Coupled Device (hereinafter, referred to as "CCD"), a Complementary Metal Oxide Semiconductor (hereinafter, referred to as "CMOS"), or another imaging element.

The optical element focuses an image of light from a predetermined reading range on the pixel of the image sensor. The reading range of the optical element is an area of a linear shape on the placing surface 32 of the document holder 12. The optical element guides light reflected by the printing medium P positioned on the placing surface 32 of the document holder 12 and transmitted through the glass plate 31 to the pixel of the image sensor, and focuses an image of light on the pixel of the image sensor.

The illumination irradiates the printing medium P with light. The illumination includes a light source and a light guiding body which guides the light emitted from the light source onto the printing medium P. The illumination irradiates an area including the reading range of the optical element with light.

The scanner unit 13 is driven by a driving mechanism (not illustrated) in a sub-scanning direction which is orthogonal to an arrangement direction (which is the main-scanning direction) of the pixel of the image sensor and parallel to the placing surface 32 to scan the image of the printing medium P placed on the placing surface 32. The scanner unit 13 is driven in the sub-scanning direction and continuously obtains an image line by line by the image sensor, so that the scanner unit 13 obtains the entire image data of the printing medium P placed on the placing surface 32 of the document holder 12.

In addition, if the printing medium P is conveyed by the ADF 14, the scanner unit 13 is positioned at a position facing a lower surface of the printing medium P which is brought into close contact by the ADF 14. By continuously reading an image line by line, at the position, by the image sensor from the printing medium P conveyed by the ADF 14, so that the scanner unit 13 reads an entire image data of the printing medium P conveyed by the ADF 14.

The paper feeding cassette 15 is a cassette which accommodates the printing medium P. The paper feeding cassette 15 is configured to be able to supply the printing medium P from an outside of the housing 11. For example, the paper feeding cassette 15 can be drawn out from the housing 11.

The paper discharge tray 16, located below the document holder 12, is a tray which receives the printing medium P discharged from the image forming apparatus 1.

Based on control of the main controller 19, the image forming unit 17 forms an image on the printing medium P. For example, the image forming unit 17 charges a drum, forms a latent image on the charged drum according to image data for printing, attaches a toner to the latent image formed on the drum, and transfers the toner attached to latent image onto the printing medium P to form a toner image on the printing medium P. For example, as illustrated in FIG. 1, the image forming unit 17 includes a drum 41, an exposure unit 42, a developing unit 43, a transfer belt 44, a pair of transfer rollers 45, a pair of fixing rollers 46, a sensor 47.

The drum 41 is a cylindrical photoconductive drum. The drum 41 is provided so as to be in contact with the transfer belt 44. An outer circumferential surface of the drum 41 is uniformly charged by a charger (not illustrated). In addition, the drum 41 rotates at a constant speed by a driving mechanism (not illustrated).

The exposure unit 42 forms an electrostatic latent image on the outer circumferential surface of the charged drum 41. By irradiating on the outer circumferential surface of the drum 41 with laser light by a light emitting element or the like according to print data, the exposure unit 42 forms an electrostatic latent image on the surface of the drum 41. The exposure unit 42 includes a light emitting unit and an optical element.

The light emitting unit has a configuration in which light emitting elements which emit light according to an electric signal are arranged in a linear manner. The light emitting element of the light emitting unit emits light having a wavelength capable of forming a latent image on the charged drum 41. The optical element forms an image of light emitted from the light emitting unit on the surface of the drum 41.

The developing unit 43 attaches a toner to the electrostatic latent image formed on the drum 41. Accordingly, the developing unit 43 forms an image of the toner on the surface of the drum 41.

The drum 41, the exposure unit 42, and the developing unit 43 of the image forming unit 17 are provided for different colors such as cyan, magenta, yellow, and black, for example. In this case, a plurality of developing units 43 hold toners of respectively different colors.

The transfer belt 44 is a member onto which the toner image is transferred from the surface of the drum 41 and transferring the received toner image onto the printing medium P. The transfer belt 44 is moved by rotation of a roller. The transfer belt 44 at a position in contact with the drum 41 receives the toner image formed on the drum 41 and conveys the received toner image to the pair of transfer rollers 45.

The pair of transfer rollers 45 is located to sandwich the transfer belt 44. When transferring the toner image onto the printing medium P, the printing medium P is sandwiched and conveyed by the outer circumferential surface of the transfer belt 44 and one of the transfer rollers 45. That is, the pair of transfer rollers 45 transfers the toner image on the transfer belt 44 to the printing medium P therebetween.

The pair of fixing rollers 46 is configured to sandwich the printing medium P therebetween. The pair of fixing rollers 46 is heated by a heater (not illustrated). The pair of fixing rollers 46 fixes the toner image formed on the printing medium P by applying pressure to the sandwiched printing medium P in a heated state. That is, the pair of fixing rollers 46 forms an image on the printing medium P by fixing the toner image.

The sensor 47 is a sensor for detecting a toner image on the transfer belt 44. For example, the sensor 47 reads an image of the toner image on the transfer belt 44. The sensor 47 includes an image sensor, an optical element, and an illumination.

The image sensor is an imaging element in which pixels which convert light into an electric signal are arranged in a linear manner. The image sensor is constituted with, for example, a CCD, a CMOS, or another imaging element.

The optical element focuses light from a predetermined reading range on the pixel of the image sensor. The reading range of the optical element is an area of a linear shape between a transfer roller 45 and the drum 41 closest to the transfer roller 45 on the transfer belt 44. The optical element focuses light reflected by a toner image formed on the transfer belt 44 and the transfer belt 44 on a pixel of the image sensor.

The illumination irradiates the transfer belt 44 with light. The illumination includes a light source and a light guiding body which guides the light emitted from the light source onto the transfer belt 44. The illumination irradiates an area including the reading range of the optical element with light.

A configuration of the sensor 47 may be any configuration as long as the sensor 47 can read an image of a toner image formed on the transfer belt 44.

The conveying unit 18 conveys the printing medium P. The conveying unit 18 includes a conveying path configured with a plurality of guides and a plurality of rollers and a sensor which detects a position of the printing medium P that is conveyed along the conveying path. The conveying path is a path along which the printing medium P is conveyed. The conveying roller conveys the printing medium P along the conveying path by being rotated by a motor operated based on control of the main controller 19. In addition, some of the plurality of guides changes the conveying path of the printing medium P by being rotated by a motor operated based on control of the main controller 19.

For example, as illustrated in FIG. 1, the conveying unit 18 includes a feed roller 51, a paper feeding path 52, a paper discharge conveying path 53, and a reverse conveying path 54.

The feed roller 51 feeds the printing medium P accommodated in the paper feeding cassette 15 to the paper feeding path 52.

The paper feeding path 52 is a conveying path for conveying the printing medium P received by the feed roller 51 from the paper feeding cassette 15 to the image forming unit 17.

The paper discharge conveying path 53 is a conveying path for discharging the printing medium P on which an image is formed by the image forming unit 17 to the outside of the housing 11. The printing medium P discharged by the paper discharge conveying path 53 is discharged onto the paper discharge tray 16.

The reverse conveying path 54 is a conveying path for supplying the printing medium P again to the image forming unit 17 in a state in which front and rear sides, front and back sides, and the like of the printing medium P on which the image is formed by the image forming unit 17 are reversed.

The main controller 19 performs control of the image forming apparatus 1. The main controller 19 includes, for example, a CPU 61, a ROM 62, a RAM 63, and a non-volatile memory 64.

The CPU 61 executes a calculation process. The CPU 61 performs various processes based on data such as a program stored in the ROM 62. The CPU 61 functions as a controller capable of executing various operation by executing the program stored in the ROM 62. The CPU 61 inputs print data for forming an image on the printing medium P to the image forming unit 17. In addition, the CPU 61 inputs a control signal instructing the conveyance of of the printing medium P to the conveying unit 18.

The ROM 62 is a read-only non-volatile memory. The ROM 62 stores a program, data used for the program, and the like.

The RAM 63 is a volatile memory which functions as a working memory. The RAM 63 temporarily stores data under a process of the CPU 61 and the like. In addition, the RAM 63 temporarily stores the program executed by the CPU 61.

The non-volatile memory 64 is a storage medium capable of storing various information. The non-volatile memory 64 stores a program, data used for the program, and the like. The non-volatile memory 64 is, for example, a solid state drive (SSD), a hard disk drive (HDD), or another storage device. Instead of the non-volatile memory 64, a memory I/F such as a card slot into which a storage medium such as a memory card can be inserted may be provided.

The display unit 20 includes a display which displays a screen according to a video signal input from the main controller 19 or a display controller such as a graphic controller (not illustrated). For example, a screen for various settings of the image forming apparatus 1 is displayed on the display of the display unit 20.

The operation I/F 21 is connected to an operating member (not illustrated). The operation I/F 21 supplies an operating signal to the main controller 19 according to operation input to the operating member. The operating member is, for example, a touch sensor, a numeric keypad, a power switch, a paper feed key, various function keys, a keyboard, or the like. The touch sensor is, for example, a resistive film touch sensor, a capacitive touch sensor, or the like. The touch sensor obtains information indicating a designated position within a certain area. The touch sensor is configured to include a touch panel integrally with the display unit 20, so that the touch sensor inputs a signal indicating a position touched by the user on a screen displayed on the display unit 20 to the main controller 19.

The communication I/F 22 is an interface for communicating with another apparatus. The communication I/F 22 is used for communication with, for example, a parent device which transmits print data to the image forming apparatus 1. The communication I/F 22 is configured to include, for example, a LAN connector. In addition, the communication I/F 22 may perform wireless communication with another apparatus according to a standard such as Bluetooth (registered trademark) or Wi-Fi (registered trademark).

The camera 23 captures a face of a person who operates the image forming apparatus 1. The camera 23 includes an image sensor, an optical element, and the like.

The image sensor is an imaging element in which pixels which convert light into an electric signal are arranged in a linear manner. The image sensor is constituted with, for example, a CCD, a CMOS, or another imaging element.

The optical element focuses an image of light from a predetermined reading range on the pixel of the image sensor. The reading range of the optical element is a predetermined range in a periphery of the image forming apparatus 1 and a range within which a face of a user who operates the image forming apparatus 1 is supposed to be viewed.

The speaker 24 outputs a sound according to an audio signal input from the main controller 19. For example, the speaker 24 outputs an alert to a user which operates the image forming apparatus 1 as a sound.

The card reader 25 is an interface for communicating with an IC card held by a user of the image forming apparatus 1. The card reader 25 transmits and receives data to and from the IC card by contact communication or contactless communication.

The IC card includes an IC chip and a circuit for communication. The IC chip includes a CPU, a ROM, a RAM, a non-volatile memory, and the like. The non-volatile memory of the IC chip has identification information corresponding to a user who uses the IC card. The circuit for communication is configured as, for example, an antenna or a contact terminal. The circuit for communication is electrically or magnetically connected to the card reader 25.

By communicating with the IC card, the card reader 25 acquires identification information indicating a user who uses the IC card from the IC card.

The image forming apparatus 1 is operated in, for example, a ready state in which an image can be formed on the printing medium P and a sleep state in which the image forming apparatus 1 waits for operation input of a predetermined operation.

If the CPU 61 is in the ready state, the CPU 61 turns on power supply to the image forming unit 17 and the conveying unit 18. That is, if the CPU 61 is in the ready state, the CPU 61 maintains the image forming unit 17 and the conveying unit 18 in an operable state. The CPU 61 switches a state of the image forming apparatus 1 from the ready state to the sleep state according to a predetermined operation, an elapsed time from last image formation, or received data. For example, if an instruction to switch the image forming apparatus 1 into the sleep state is received from an external apparatus via the communication I/F 22, an elapsed time from last image formation is equal to or more than a predetermined time, or an instruction to switch the image forming apparatus 1 into the sleep state is received by the operation I/F 21, the CPU 61 switches a state of the image forming apparatus 1 from the ready state to the sleep state.

If the CPU 61 is in the sleep state, the CPU 61 turns off power supply to the image forming unit 17 and the conveying unit 18. The CPU 61 switches a state of the image forming apparatus 1 from the sleep state to the ready state according to a predetermined operation or received data. For example, if print data is received from an external apparatus via the communication I/F 22 or an operation to instruct image formation is input by the operation I/F 21, the CPU 61 switches a state of the image forming apparatus 1 from the sleep state to the ready state. In addition, for example, if power supply of the image forming apparatus 1 is switched from OFF to ON, that is, if the image forming apparatus 1 is activated, the CPU 61 switches a state of the image forming apparatus 1 from the sleep state to the ready state.

In addition, when a state of the image forming apparatus 1 is switched from the sleep state to the ready state, the CPU 61 performs an image stabilization process as necessary.

The image stabilization process is a process in which a toner concentration of a toner image formed by the image forming unit 17, a position at which the toner image is formed, and the like are adjusted according to the toner image formed on the transfer belt 44.

When the image stabilization process is performed, the CPU 61 of the main controller 19 controls the image forming unit 17 to form a toner image of a predetermined design on the transfer belt 44. The CPU 61 causes the sensor 47 to read an image of the toner image formed on the transfer belt 44. Based on the read image of the toner image on the transfer belt 44, the CPU 61 performs the image stabilization process. That is, the CPU 61 and the image forming unit 17 function as image stabilization processing units.

The image stabilization process includes, for example, a concentration adjustment process, a position adjustment process, or other processes for improving image quality of an image.

For example, the CPU 61 performs the concentration adjustment process in which the amount of toner of a toner image formed on the transfer belt 44 is adjusted. Accordingly, the CPU 61 adjusts a concentration of an image formed on the printing medium P.

In a case where the image forming unit 17 includes the drum 41 for each of a plurality of colors, the exposure unit 42, and the developing unit 43, the CPU 61 performs the position adjustment process in which a position at which an electrostatic latent image is formed on the drum 41 corresponding to each of the colors is adjusted. Accordingly, the CPU 61 reduces a positional deviation of the toner image for each of the colors formed on the transfer belt 44.

The CPU 61 recognizes a person who uses the image forming apparatus 1 based on a recognition process described later and determines whether or not to perform the image stabilization process according to the recognized person. For this reason, the CPU 61 stores a necessity determination table in non-volatile memory 64. This table stores identification information indicating a person, authentication information, and necessity information indicating necessity of the image stabilization process in association with each other, in advance. For example, the necessity information corresponding to a person who does not emphasize the image quality of the image formation indicates that the image stabilization process is not necessary. On the other hand, the necessity information corresponding to a person who emphasizes the image quality of the image formation indicates that the image stabilization process is necessary. For example, the necessity information is registered based on inputs from a user.

The CPU 61 obtains information related to a person who uses the image forming apparatus 1 and performs user authentication in which the identification information of the person who uses the image forming apparatus 1 is recognized based on the obtained information and authentication information of the necessity determination table. That is, the CPU 61 functions as a user authentication unit.

For example, the CPU 61 recognizes a person who uses the image forming apparatus 1 by face authentication. In this case, the CPU 61 saves facial features extracted in advance from a facial image of the person in the necessity determination table as authentication information. Further, if a person approaches the image forming apparatus 1, the CPU 61 causes the camera 23 to capture a face of the person who approaches the image forming apparatus 1, that is, the person who uses the image forming apparatus 1. The CPU 61 compares the obtained facial image with a plurality of facial features saved in the necessity determination table and specifies one facial feature according to a comparison result. For example, the CPU 61 calculates a similarity between the obtained facial image and each of the plurality of facial features saved in the necessity determination table and specifies a facial feature which is most similar to the obtained facial image out of the plurality of facial features saved in the necessity determination table. The CPU 61 recognizes identification information in association with the specified facial feature with reference to the necessity determination table of the non-volatile memory 64.

Further, based on necessity information in association with the recognized identification information, the CPU 61 determines whether or not to execute the image stabilization process. That is, the CPU 61 functions as a determination unit which determines whether or not to execute the image stabilization process according to a result of user authentication. For example, the CPU 61 determines whether necessity information in association with the recognized identification information indicates "necessary" or "unnecessary" with reference to the necessity determination table. If it is determined that the necessity information indicates "necessary", the CPU 61 executes the image stabilization process when switching a state of the image forming apparatus 1 from the sleep state to the ready state. In addition, if it is determined that the necessity information indicates "unnecessary", the CPU 61 does not execute the image stabilization process and switches a state of the image forming apparatus 1 from the sleep state to the ready state.

The CPU 61 may rewrite the necessity determination table according to operation input to the operation I/F 21 by the user or information input via the communication I/F 22.

Figure 3:
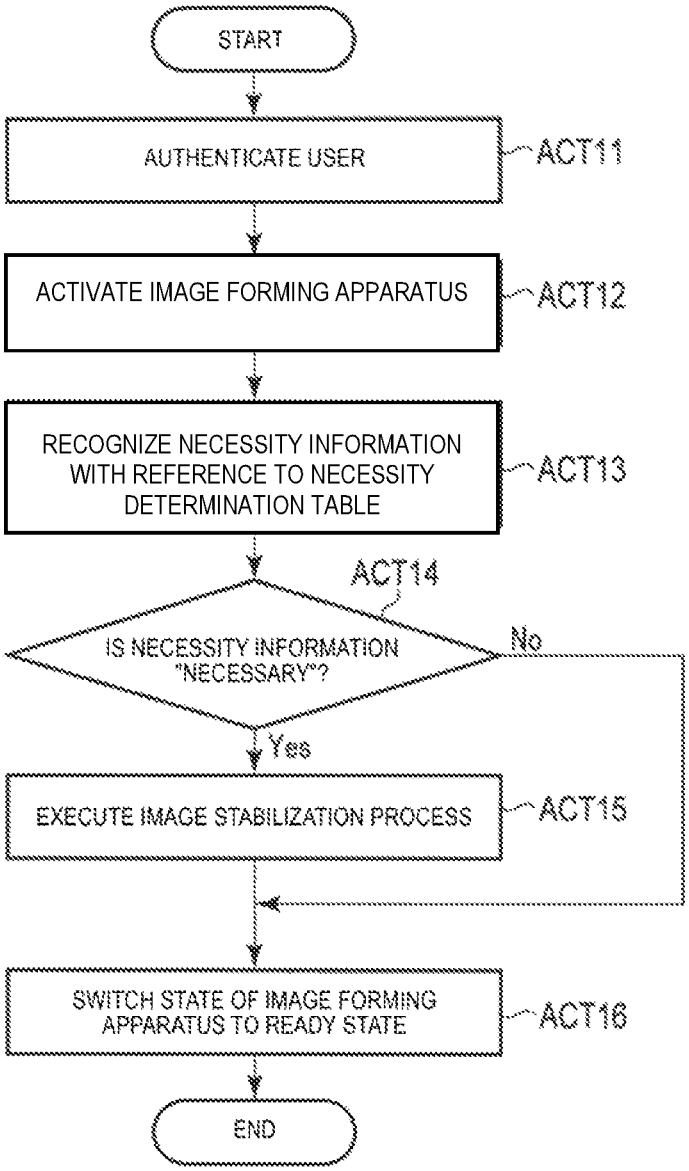
FIG. 3 is a flowchart depicting an example of operation of the image forming apparatus according to the embodiment.

FIG. 3 is a flowchart depicting operation of the image forming apparatus 1.

The CPU 61 obtains information related to a person who uses the image forming apparatus 1 and performs user authentication based on the obtained information and authentication information of the necessity determination table (ACT 11). Accordingly, the CPU 61 identifies the person who uses the image forming apparatus 1. Specifically, the CPU 61 obtains a facial image of the person who approaches the image forming apparatus 1 by the camera 23. The CPU 61 compares the obtained facial image with a plurality of facial features saved in the necessity determination table and specifies one facial feature which is most similar to the obtained facial image out of the plurality of facial features saved in the necessity determination table according to a comparison result. The CPU 61 recognizes identification information in association with the specified facial feature with reference to the necessity determination table.

Instead of face authentication as described above, the CPU 61 may be configured to perform user authentication by PIN key authentication, card authentication, or fingerprint authentication. If user authentication is performed by the PIN key authentication, the CPU 61 compares information (PIN) input to the operation I/F 21 with preset PIN as authentication information and recognizes identification information of a user according to a comparison result.

In addition, if user authentication is performed by the card authentication, the CPU 61 compares information read by the card reader 25 from an IC card held by a user with authentication information and recognizes identification information of the user according to a comparison result.

In addition, if user authentication is performed by the fingerprint authentication, the CPU 61 obtains an image of a fingerprint of a user by a fingerprint sensor (not illustrated), compares the obtained fingerprint image with a pre-registered fingerprint image as authentication information, and recognizes identification information of the user according to a comparison result.

In addition, when image formation is performed based on print data input from an external apparatus via the communication I/F 22, the CPU 61 may recognize identification information of a user by extracting identification information of the user included in the print data.

When the user authentication is performed, the CPU 61 activates the image forming apparatus 1 (ACT 12). Accordingly, the CPU 61 starts to switch a state of the image forming apparatus 1 from the sleep state to the ready state.

The CPU 61 recognizes necessity information in association with the identification information recognized in ACT 11 with reference to the necessity determination table (ACT 13).

Based on the recognized necessity information, the CPU 61 determines whether or not to execute the image stabilization process (ACT 14). If the necessity information indicates "necessary", the CPU 61 determines to execute the image stabilization process. If the necessity information indicates "unnecessary", the CPU 61 determines not to execute the image stabilization process.

If it is determined to execute the image stabilization process (YES in ACT 14), the CPU 61 executes the image stabilization process (ACT 15) and moves to a process of ACT 16. In addition, if it is determined not to execute the image stabilization process (NO in ACT 14), the CPU 61 moves to the process of ACT 16.

The CPU 61 switches a state of the image forming apparatus 1 into the ready state (ACT 16). Accordingly, the image forming apparatus 1 enters a state capable of forming an image on the printing medium P.

As described above, the image forming apparatus 1 includes the image forming unit 17 which forms an image on a printing medium and the CPU 61. The CPU 61 performs user authentication and determines whether or not to perform the image stabilization process in the image forming unit 17 according to a result of user authentication. According to such a configuration, the image forming apparatus 1 can determine whether or not the image stabilization process is necessary according to a request of a user. That is, if a user who emphasizes image quality instructs printing, the image forming apparatus 1 performs image formation after performing the image stabilization process, and if a user who does not emphasize image quality instructs printing, the image forming apparatus 1 performs image formation without the image stabilization process. Accordingly, the image forming apparatus 1 can improve image quality of image formation instructed by the user who emphasizes image quality and can perform image formation instructed by the user who does not emphasize image quality at high processing speed. As a result, the image forming apparatus 1 can improve convenience.

Further, the image forming apparatus 1 determines whether or not to perform the image stabilization process with reference to the necessity determination table in which necessity of the image stabilization process is set for each user. Accordingly, the image forming apparatus 1 can determine whether or not to perform the image stabilization process according to a purpose of the user.

In addition, the embodiment described above explains that necessity (necessity information) of the image stabilization process is associated with each user's identification information in the necessity determination table, but a configuration of the embodiment is not limited thereto. In the necessity determination table, the identification information of the user is not identification information of an individual but may be set for each of groups to which a plurality of individuals belong. For example, the CPU 61 of the image forming apparatus 1 saves a table, in which identification information of a user and identification information for each of the groups are associated with each other, in advance. The CPU 61 performs user authentication and recognizes a group to which the authenticated user belongs based on the identification information of the user. Based on the necessity information in association with the recognized identification information of the group, the CPU 61 determines whether or not to execute the image stabilization process.

In addition, the embodiment described above explains that the image forming apparatus 1 determines whether or not to execute the image stabilization process based on necessity information indicating necessity of the image stabilization process for each user, but a configuration of the embodiment is not limited thereto. The image forming apparatus 1 may be configured to determine whether or not to execute each of a plurality of processes included in the image stabilization process. That is, the image forming apparatus 1 may be configured to respectively determine whether or not to execute each of the concentration adjustment process, the position adjustment process, and the like.

In addition, when performing monochromatic image formation, there is no need to perform the position adjustment process. The image forming apparatus 1 may be configured to determine whether or not to execute the concentration adjustment process based on the necessity information.

In addition, the embodiment described above explains that the image forming apparatus 1 determines whether or not to execute the image stabilization process based on necessity information indicating necessity of the image stabilization process for each user, but a configuration of the embodiment is not limited thereto. The CPU 61 of the image forming apparatus 1 may be configured to determine whether or not to perform the image stabilization process based on a processing history in the past for each user.

Figure 4:
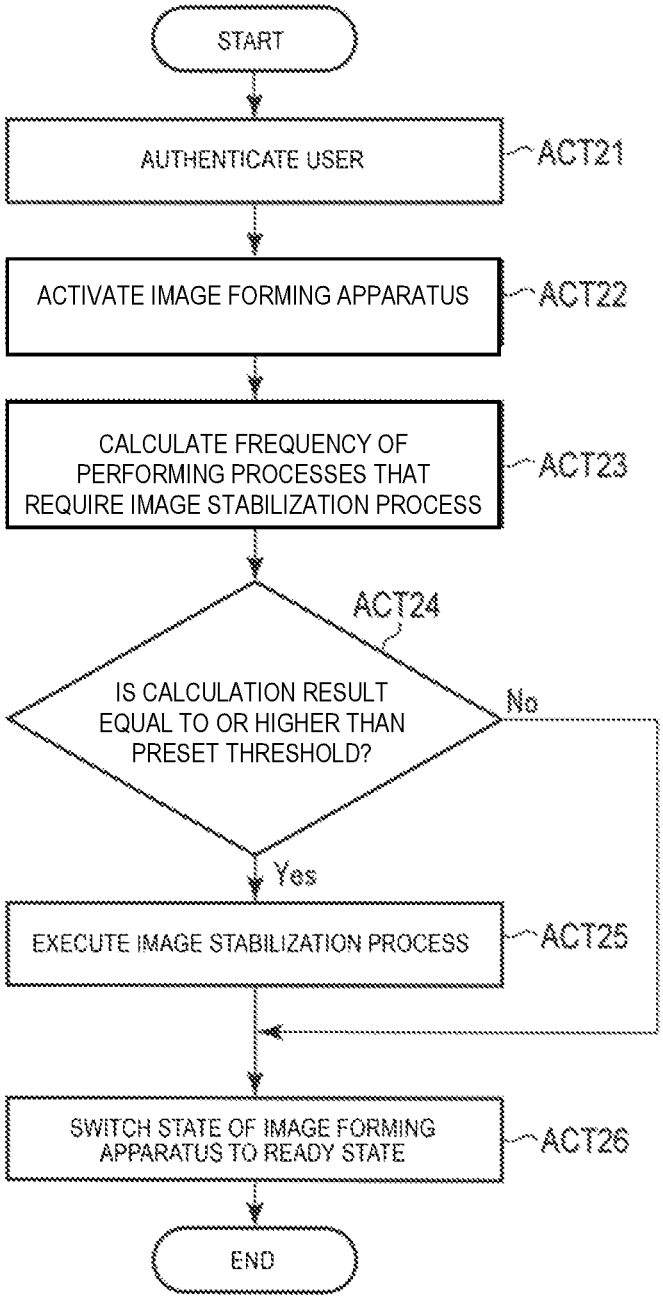
FIG. 4 is a diagram for explaining an example of operation of the image forming apparatus according to the embodiment.

FIG. 4 is an explanatory diagram for explaining another operation of the image forming apparatus 1. This example explains that the image forming apparatus 1 determines whether or not to execute the image stabilization process not based on necessity information indicating necessity of the image stabilization process for each user but based on the processing history for each user. If the image forming apparatus 1 is configured as described above, the CPU 61 saves a necessity determination table, in which identification information for each user, authentication information for identifying the user, and the processing history are associated with each other, in the non-volatile memory 64.

The processing history is information indicating a history of a process such as an image reading process, a monochromatic image forming process, an image forming process of a plurality of colors, or the like. When performing these processes after user authentication, the CPU 61 saves the processing history in association with the identification information of a user in the necessity determination table. In this example, it is assumed that the image forming process of the plurality of colors is a process requiring the image stabilization process, and the image reading process and the monochromatic image forming process are processes not requiring the image stabilization process. That is, the processing history is information indicating a history of the image forming process of the plurality of colors and processes other than the image forming process of the plurality of colors.

The CPU 61 obtains information related to a user of the image forming apparatus 1 and performs user authentication based on the obtained information and authentication information of the necessity determination table (ACT 21). Accordingly, the CPU 61 identifies the user of the image forming apparatus 1.

When performing user authentication, the CPU 61 activates the image forming apparatus 1 (ACT 22). Accordingly, the CPU 61 starts to switch a state of the image forming apparatus 1 from the sleep state to the ready state.

The CPU 61 recognizes a processing history in association with the identification information recognized in ACT 21 and calculates a frequency of performing processes that require the image stabilization process with reference to the necessity determination table (ACT 23). For example, the CPU 61 calculates a frequency of performing processes that require the image stabilization process with reference to the processing history for a predetermined number of times in the past. In addition, for example, the CPU 61 calculates a frequency of performing processes that require the image stabilization process with reference to the processing history for a predetermined period in the past. Specifically, the CPU 61 calculates a frequency of performing the image forming process of the plurality of colors to processes other than the image forming process of the plurality of colors with reference to the processing history in association with the identification information recognized in ACT 21.

Based on the recognized processing history, the CPU 61 determines whether or not to execute the image stabilization process. The CPU 61 determines whether or not a calculation result of a frequency of performing processes that require the image stabilization process is equal to or higher than a preset threshold (ACT 24). For example, if the calculation result of the frequency of performing the processes that require the image stabilization process is equal to or higher than the preset threshold, the CPU 61 determines to execute the image stabilization process. In addition, if the calculation result of the frequency of performing the processes that require the image stabilization process is lower than the preset threshold, the CPU 61 determines not to execute the image stabilization process.

If it is determined to execute the image stabilization process (YES in ACT 24), the CPU 61 executes the image stabilization process (ACT 25) and shifts to a process of ACT 26. On the other hand, if it is determined not to execute the image stabilization process (NO in ACT 24), the CPU 61 shifts to the process of ACT 26.

The CPU 61 switches a state of the image forming apparatus 1 into the ready state (ACT 26). Accordingly, the image forming apparatus 1 enters a state capable of forming an image on the printing medium P.

As described above, the image forming apparatus 1 saves the processing history for each user and determines whether or not to perform the image stabilization process based on whether or not a frequency of performing processes that require the image stabilization process is equal to or higher than a preset threshold. Accordingly, the image forming apparatus 1 can determine whether or not the image stabilization process is necessary based on the processing history without being conscious of a user. That is, if a user who instructed processes that require the image stabilization process at a high frequency in the past, instructs printing, the image forming apparatus 1 performs image formation after performing the image stabilization process, and if a user who instructed processes that require the image stabilization process at a low frequency, instructs printing, the image forming apparatus 1 performs image formation without the image stabilization process. Accordingly, the image forming apparatus 1 can improve image quality of image formation in a case where the user instructed processes that require the image stabilization process at a high frequency in the past and can avoid a waiting time of a user occurs in a case where the user did not instruct processes that require the image stabilization process at a high frequency in the past. As a result, it is possible to improve convenience of the image forming apparatus 1.

As described above, the image forming apparatus 1 is configured to determine necessity of the image stabilization process when switching a state of the image forming apparatus 1 from the sleep state to the ready state, but the configuration is not limited thereto. The image forming apparatus 1 may be configured to sequentially detect a temperature and humidity and determine whether or not the image stabilization processing is necessary according to a change in the temperature and the humidity.

In addition, the image forming apparatus 1 may be configured to determine whether or not the image stabilization processing is necessary when the number of the printing medium P on which images are continuously formed is equal to or larger than a preset number.

The functions in the embodiment described above may be realized not only by using hardware but also by reading a program describing each of functions using software into a computer. In addition, each of the functions may be configured by selecting software or hardware as appropriate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit configured to form an image on a printing medium; and a processor configured to perform user authentication and, upon performing the user authentication, determine whether or not an image stabilization process should be performed in the image forming unit, wherein the processor instructs the image forming unit to perform the image stabilization process according to a result of the user authentication.

2. The apparatus according to claim 1, further comprising:

a storage unit in which identification information of users are stored in association with information indicating whether or not the image stabilization process is to be performed, wherein the processor determines whether or not the image stabilization process should be performed in the image forming unit with reference to the information stored in the storage unit.

3. The apparatus according to claim 2, wherein if the authenticated user is associated with information indicating that the image stabilization process is to be performed, the processor instructs the image forming unit to perform the image stabilization process prior to performing any print job for the authenticated user.

4. The apparatus according to claim 2, wherein if the authenticated user is associated with information indicating that the image stabilization process is not to be performed, the processor does not instruct the image forming unit to perform the image stabilization process and a print job for the authenticated user is performed without first performing the image stabilization process in the image forming unit.

5. The apparatus according to claim 1, further comprising:

a storage unit in which identification information of users are stored in association with a processing history which indicates a history of performing processes that require the image stabilization process and performing processes that do not require the image stabilization process, wherein the processor determines whether or not the image stabilization process should be performed in the image processing unit with reference to the processing history stored in the storage unit.

6. The apparatus according to claim 5, wherein the processing history indicates a frequency of performing processes that require the image stabilization process, and if the authenticated user is associated with a frequency higher than a threshold frequency, the processor instructs the image forming unit to perform the image stabilization process prior to performing any print job for the authenticated user, and if the authenticated user is associated with a frequency lower than the threshold frequency, the processor does not instruct the image forming unit to perform the image stabilization process and a print job for the authenticated user is performed without first performing the image stabilization process in the image forming unit.

7. The apparatus according to claim 1, wherein the authenticated user is an individual or a group to which the individual belongs.

8. The apparatus according to claim 1, wherein print data for the authenticated user that is to be printed using the image forming unit is transmitted to the image forming apparatus prior to the user authentication, and the processor is configured to determine whether or not to execute a position adjustment process according to the result of the user authentication, if the print data instructs printing with a plurality of colors.

9. The apparatus according to claim 1, wherein the processor performs user authentication based on a physical feature of the authenticated user.

10. The apparatus according to claim 9, wherein the processor performs user authentication based on a facial feature of the authenticated user.

11. A method of controlling an image forming apparatus having an image forming unit configured to form an image on a printing medium, the method comprising:

performing user authentication;

determining whether or not an image stabilization process should be performed in the image forming unit according to a result of the user authentication; and instructing the image forming unit to perform the image stabilization process according to a result of the determination.

12. The method according to claim 11, wherein the image forming apparatus further comprises a storage unit in which identification information of users are stored in association with information indicating whether or not the image stabilization process is to be performed, and the method further comprises determining whether or not the image stabilization process should be performed in the image forming unit with reference to the information stored in the storage unit.

13. The method according to claim 12, further comprising:

if the authenticated user is associated with information indicating that the image stabilization process is to be performed, instructing the image forming unit to perform the image stabilization process prior to performing any print job for the authenticated user.

14. The method according to claim 12, further comprising:

if the authenticated user is associated with information indicating that the image stabilization process is not to be performed, not instructing the image forming unit to perform the image stabilization process and a print job for the authenticated user is performed without first performing the image stabilization process in the image forming unit.

15. The method according to claim 11, wherein the image forming apparatus further comprises a storage unit in which identification information of users are stored in association with a processing history which indicates a history of performing processes that require the image stabilization process and performing processes that do not require the image stabilization process, and the method further comprises determining whether or not the image stabilization process should be performed in the image processing unit with reference to the processing history stored in the storage unit.

16. The method according to claim 15, wherein the processing history indicates a frequency of performing processes that require the image stabilization process, and the method further comprises:

if the authenticated user is associated with a frequency higher than a threshold frequency, instructing the image forming unit to perform the image stabilization process prior to performing any print job for the authenticated user, and if the authenticated user is associated with a frequency lower than the threshold frequency, not instructing the image forming unit to perform the image stabilization process and performing a print job for the authenticated user without first performing the image stabilization process in the image forming unit.

17. The method according to claim 11, wherein the authenticated user is an individual or a group to which the individual belongs.

18. The method according to claim 11, wherein print data for the authenticated user that is to be printed using the image forming unit is transmitted to the image forming apparatus prior to the user authentication, and the method further comprises: determining whether or not to execute a position adjustment process according to the result of the user authentication, if the print data instructs printing with a plurality of colors.

19. The method according to claim 11, further comprising performing user authentication based on a physical feature of the authenticated user.

20. The method according to claim 19, further comprising performing user authentication based on a facial feature of the authenticated user.

* * * * *